US007615142B2

(12) United States Patent
Lee et al.

(10) Patent No.: US 7,615,142 B2
(45) Date of Patent: Nov. 10, 2009

(54) EXPANDED BED REACTOR SYSTEM AND METHOD FOR HYDROPROCESSING WAX PRODUCED BY FISCHER-TROPSCH REACTION AND CONTAMINATED WITH SOLIDS

(75) Inventors: Lap-Keung Lee, West Windsor, NJ (US); Lawrence M. Abrams, Cherry Hill, NJ (US)

(73) Assignee: Headwaters Technology Innovation, LLC, Lawrenceville, NJ (US)

( * ) Notice: Subject to any disclaimer, the term of this patent is extended or adjusted under 35 U.S.C. 154(b) by 197 days.

(21) Appl. No.: 11/469,237

(22) Filed: Aug. 31, 2006

(65) Prior Publication Data

US 2008/0053871 A1 Mar. 6, 2008

(51) Int. Cl.
*C10G 47/02* (2006.01)

(52) U.S. Cl. ..... 208/107; 208/108; 208/109

(58) Field of Classification Search ..... None
See application file for complete search history.

(56) References Cited

U.S. PATENT DOCUMENTS

| | | | | |
|---|---|---|---|---|
| 3,923,635 | A | 12/1975 | Schulman et al. | 208/50 |
| 4,605,678 | A | 8/1986 | Brennan et al. | 518/700 |
| 5,520,890 | A | 5/1996 | Lorentzen et al. | 422/197 |
| 5,705,052 | A | 1/1998 | Gupta | 208/57 |
| 5,720,872 | A | 2/1998 | Gupta | 208/57 |
| 5,827,903 | A | 10/1998 | White et al. | 518/710 |
| 5,954,945 | A | 9/1999 | Cayton et al. | 208/108 |
| 6,068,760 | A | 5/2000 | Benham et al. | 518/700 |
| 6,096,789 | A | 8/2000 | Clerici et al. | 518/706 |
| 6,265,451 | B1 | 7/2001 | Zhou et al. | 518/700 |
| 6,277,895 | B1 | 8/2001 | Zhou et al. | 518/715 |
| 6,315,890 | B1 * | 11/2001 | Ladwig et al. | 208/67 |
| 6,436,279 | B1 | 8/2002 | Colyar | 208/108 |
| 6,462,098 | B1 * | 10/2002 | Vogel et al. | 518/700 |
| 6,476,086 | B1 | 11/2002 | Zhou | 518/719 |
| 6,777,452 | B2 | 8/2004 | Zhou et al. | 518/713 |
| 6,797,153 | B1 | 9/2004 | Fukuyama et al. | 208/58 |
| 6,903,141 | B2 | 6/2005 | Zhou et al. | 518/719 |
| 6,960,325 | B2 | 11/2005 | Kao et al. | 422/145 |
| 2001/0042702 | A1 | 11/2001 | Stuntz et al. | |
| 2002/0112990 | A1 | 8/2002 | Iaccino et al. | 208/210 |
| 2003/0089638 | A1 | 5/2003 | Gueret et al. | 208/97 |
| 2004/0004020 | A1 | 1/2004 | Grove et al. | 208/49 |
| 2004/0209771 | A1 | 10/2004 | Abe et al. | 502/313 |
| 2004/0256293 | A1 | 12/2004 | Abe et al. | 208/210 |
| 2005/0222481 | A1 | 10/2005 | Johnson | 585/820 |

FOREIGN PATENT DOCUMENTS

| | | |
|---|---|---|
| CA | 1176198 | 10/1984 |
| JP | 60044587 | 3/1985 |

* cited by examiner

*Primary Examiner*—Tam M Nguyen
(74) *Attorney, Agent, or Firm*—Workman Nydegger

(57) ABSTRACT

An expanded bed hydroprocessing system and related method includes at least one expanded bed reactor that employs a solid catalyst to catalyze hydroprocessing reactions involving hydrogen and a high molecular weight hydrocarbon feedstock (e.g., a Fischer-Tropsch wax) that is contaminated with solid particulates. Hydroprocessing the high molecular weight hydrocarbon feedstock in an expanded bed reactor results in formation of a hydroprocessed material from the hydrocarbon feedstock, while eliminating the risk of plugging of the supported catalyst bed by the solid particulates as compared to a reactor including a stationary catalyst bed.

20 Claims, 4 Drawing Sheets

EXPANDED BED REACTOR SYSTEM AND METHOD FOR HYDROPROCESSING WAX PRODUCED BY FISCHER-TROPSCH REACTION AND CONTAMINATED WITH SOLIDS

BACKGROUND OF THE INVENTION

1. The Field of the Invention

The present invention is in the field of hydrocracking high molecular weight hydrocarbon waxes into lower molecular weight, lower boiling point, higher quality materials. More particularly, the invention relates to a system and method for hydrocracking hydrocarbon waxes generated by a Fischer-Tropsch process that are contaminated with solid particulate impurities such as catalyst fines.

2. Related Technology

The conversion of fossil fuels such as coal, natural gas and petroleum coke to liquid hydrocarbon fuels and/or chemicals has been the subject of intensive research and development throughout the industrialized world for many years to provide a practical alternative to petroleum crude oil production and open-up the world's vast reserves of coal as a competitive source for essential hydrocarbons. Many processes have been developed for the direct or indirect catalytic hydrogenation of fossil fuels to yield liquid hydrocarbons. Some large pilot plants have been built and operated, and several commercial scale plants have been built for the conversion of coal to primarily liquid hydrocarbons. Of these plants, most were built by the German government during World War II. About half of them were built using the well-known Fischer-Tropsch process for converting synthesis gas to liquid hydrocarbons in contact with an iron catalyst. Such plants, operationally at least, worked well enough for war-time needs. Subsequently, the South African Government (SASOL, Ltd) built commercial size coal conversion plants to produce hydrocarbon fuels and chemicals which also were successfully based on indirect conversion using Fischer-Tropsch chemistry and iron catalysis.

From an operational point of view, the commercial liquefaction of coal or natural gas based on indirect Fischer-Tropsch (F-T) chemistry has been demonstrated to be an engineering success. However, true economic success has so far eluded the developers of direct or indirect coal or natural gas liquefaction processes, largely because of the historically low cost of crude oil as the competitive alternative. Nevertheless, there is now a genuine potential for indirect coal or natural gas liquefaction via Fisher-Tropsch (F-T) chemistry in view of more recent increases in crude oil price.

A known, practical method for preparing liquid hydrocarbons rich in valuable α-olefins is to convert a relatively low cost hydrocarbon material (e.g., coal, biomass or natural gas), to synthesis gas, i.e., a mixture of carbon monoxide and hydrogen, by partial oxidation and/or steam reforming, which is followed by conversion of the synthesis gas to liquid hydrocarbons over a F-T catalyst (e.g., iron or cobalt). However, many catalysts used in the F-T process are especially fragile and break down easily in the F-T synthesis reactor into very fine particulates. In addition, a significant portion of the F-T synthesis products comprise high molecular weight, high boiling waxy hydrocarbons, which become mixed with the catalyst particles. These fine particles become dispersed throughout the waxy F-T product, and must typically be removed prior to hydrocracking the waxy F-T product because the solid particulates will otherwise cause plugging of downstream hydroprocessing reactors used to upgrade the waxy portion of the F-T products (i.e., fixed bed reactors having a stationary catalyst bed).

Hydrocracking the F-T waxy product portion to produce lower boiling point, more valuable products such as naphtha, diesel, and other light hydrocarbons is normally accomplished in a fixed bed reactors with stationary catalyst beds. In existing systems, hydrocracking and other hydroprocessing catalysts are arranged as a fixed or stationary bed within the reactor. The fixed bed may include a porous substrate having a very large surface area throughout which an active metal catalyst is dispersed. If catalyst fines (e.g., having an effective diameter less than about 200 microns) carried over from the F-T synthesis reactor are not suffiently separated from the wax before hydroprocessing, they will typically pile up within the interstitial spaces between the fixed bed of supported catalyst, thereby plugging the space between the supported catalyst where the liquid would normally flow. Extremely small fines can also plug the pores of the supported catalyst. The result is a drop in pressure, a loss of catalyst action, and a reduction in product yields. Deactivation of the fixed catalyst bed requires the reactor to be shut down for cleaning and catalyst replacement, which is extremely inconvenient, time consuming, and expensive.

While necessary with existing methods, separation of the solid particulates from the waxy product of the F-T process represents an added expense, and separation of the very fine particles from the wax can be extremely difficult. Costly and complicated separation processes, such as centrifuging or ultrafiltration, must be employed to effect removal of the very small catalyst particles so as to prevent plugging and deactivation of the downstream hydroprocessing equipment.

It would thus be a significant improvement in the art to provide a method and system for hydroprocessing the F-T wax products contaminated with solid particulates to produce more valuable lower molecular weight, lower boiling range products without requiring separation of the solid particulates from the F-T wax feedstock.

SUMMARY OF THE INVENTION

The present invention is directed to a method and related system for hydroprocessing a Fischer-Tropsch ("F-T") generated wax that is contaminated with fine catalyst particulates. The inventive hydroprocessing system includes at least one expanded bed reactor, also known as a three-phase fluidized bed, which employs a porous catalyst to catalyze hydroprocessing reactions involving hydrogen and a high molecular weight hydrocarbon feedstock (e.g., a Fisher-Tropsch generated wax) that is contaminated with solid particulates. Hydroprocessing the high molecular weight hydrocarbon in an expanded bed reactor results in formation of a hydroprocessed material from the hydrocarbon feedstock while advantageously reducing or eliminating plugging of the porous catalyst by the solid particulates, as otherwise occurs if using a fixed bed reactor.

Advantageously, hydrocracking the wax product within an expanded bed reactor eliminates the need to filter or otherwise separate the solid particulates from the contaminated wax prior to hydroprocessing. Unlike a fixed bed reactor, the catalyst structures in an expanded bed are not stationary but in motion. This reduces the tendency of catalyst fines carried in the wax produced by the Fisher-Tropsch process to plug the catalyst bed, since the catalyst bed remains in motion.

The related inventive method comprises providing a feed stream of high molecular weight hydrocarbons that is contaminated with solid particulates (e.g., a Fisher-Tropsch generated wax contaminated with solid particulates worn away from the solid catalyst used in the Fisher-Tropsch reactor). The feed stream includes a mixture of high molecular weight hydrocarbons and solid particulates that are dispersed throughout the high molecular weight hydrocarbons. One or more expanded bed reactors are provided. Each expanded bed reactor includes a solid phase comprised of an expanded bed of a porous catalyst and a gaseous phase comprised of hydrogen rich gas. The liquid phase feed stream of high molecular weight hydrocarbons contaminated with solid particulates is introduced into the at least one expanded bed reactor. The expanded bed reactor advantageously operates to form a hydro-processed (e.g., hydrocracked) material from the high molecular weight hydrocarbons without requiring pre-filtering of the wax. As mentioned, it has surprisingly been found that the feed stream of high molecular weight hydrocarbons contaminated with solid particulates can be introduced into the expanded bed reactor and hydroprocessed without any significant risk of plugging or deactivation of the porous catalyst. This is advantageous as it eliminates the necessity of filtering any of the solid particulates from the hydrocarbon before introducing the material into a hydroprocessing reactor.

The inventive method and system is advantageously capable of hydroprocessing a high molecular weight hydrocarbon wax having a relatively high concentration of particulate contaminants. In one example the concentration of solid particulates within the feed stream of high molecular weight hydrocarbons may be between about 5 ppm and about 50,000 ppm. A more typical concentration of solid particulates may be between about 10 ppm and about 5000 ppm, most typically between about 20 ppm and about 2000 ppm. The solid particulates may include a distribution of various sizes, for example from an effective diameter of about 200 microns or more down to an effective diameter of less than 1 micron.

In general, expanded bed hydroprocessing systems have been developed to upgrade heavy oil feedstocks rich in asphaltines and other fractions that are difficult to process using other hydroprocessing systems. Expanded beds have not, however, been used to hydroprocess hydrocarbon waxes, such as may be formed by F-T processes, which yield relatively simple aliphatic waxes as a lower value fraction. It has now been discovered that expanded bed hydroprocessing systems, though relatively expensive to operate, are well suited to hydroprocess mainly aliphatic waxes generated by F-T processes because they eliminate the need to employ expensive and time consuming separation techniques to remove solid particulates from the F-T wax prior to hydroprocessing.

These and other advantages and benefits of the present invention will become more fully apparent from the following description and appended claims as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF THE PREFERRED EMBODIMENTS

I. Definitions and Introduction

Figure 1:
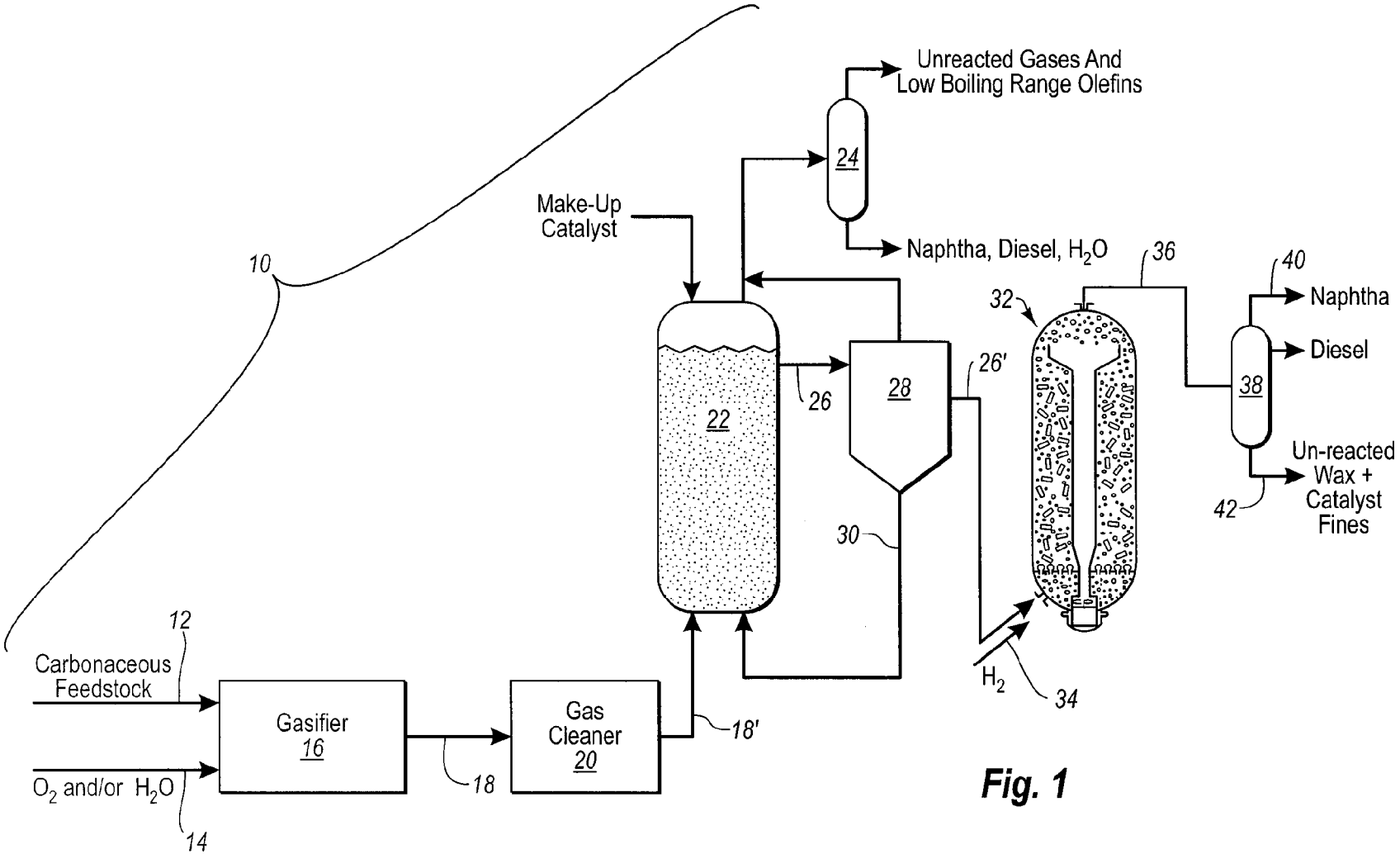
FIG. 1 is a schematic diagram illustrating an exemplary slurry bed system for forming a Fischer-Tropsch high molecular weight hydrocarbon wax followed by hydrocracking the wax in an expanded bed reactor.

The term "hydrocracking" shall refer to a process whose primary purpose is to reduce the boiling range of a high molecular weight hydrocarbon and in which a substantial portion of the material is converted into products with boiling ranges lower than that of the original feedstock. Hydrocracking generally involves fragmentation of larger hydrocarbon molecules in the presence of hydrogen into smaller molecular fragments having a fewer number of carbon atoms and a higher hydrogen-to-carbon ratio. The mechanism by which hydrocracking occurs typically involves the formation of hydrocarbon free radicals during fragmentation followed by capping of the free radical ends or moieties with hydrogen. The hydrogen atoms or radicals that react with hydrocarbon free radicals during hydrocracking are generated at or by active catalyst sites.

The term "hydrotreating" shall refer to a more mild operation whose primary purpose is to remove impurities such as sulfur, nitrogen, oxygen, halides, and trace metals from the hydrocarbon and saturate olefins and/or stabilize hydrocarbon free radicals by reacting them with hydrogen rather than allowing them to react with themselves. The primary purpose is not to change the boiling range of the feedstock.

Of course, "hydrocracking" may also involve the removal of sulfur and nitrogen from a feedstock as well as olefin saturation and other reactions typically associated with "hydrotreating". The term "hydroprocessing" shall broadly refer to both "hydrocracking" and "hydrotreating" processes, which define opposite ends of a spectrum, and everything in between along the spectrum.

The terms "solid catalyst", "porous catalyst" and "catalyst" shall refer to catalysts that are typically used in expanded bed hydroprocessing systems, including catalysts designed primarily for hydrocracking or hydrodemetallization and catalysts designed primarily for hydrotreating. Such catalysts typically comprise (i) a catalyst support having a large surface area and numerous interconnected channels or pores of uneven diameter and (ii) fine particles of an active metal catalyst dispersed within the pores. An example of a hydrocracking catalyst/support suitable for use with low sulfur Fischer-Tropsch wax is a solid acidic metal oxide (e.g., super acid) such as alumina, silica, zirconia, or tungsten oxide ($WO_3$), optionally containing a small amount of platinum, nickel or molybdenum, or other metal as a catalytically active promoter. The pores of the solid catalyst are of limited size due to the desirability for the catalyst to maintain mechanical integrity to prevent excessive breakdown and formation of excessive fines in the reactor. Catalysts are commonly produced as cylindrical pellets or spherical solids.

An exemplary hydrocracking catalyst suitable for hydrocracking Fischer-Tropsch wax includes platinum catalyst particles formed from $H_2PtCl_6$ and/or $Pt(NH_3)_4Cl_2$ deposited on a porous super acid catalyst support comprising tungstated zirconia ($ZrO_2/WO_3$). The supported catalyst may also contain Y-type zeolites, examples of which include CBV-21A, CBV-720 and CBV-901, which are available from Zeolist Inc.

The term "high molecular weight hydrocarbon" shall refer to heavy hydrocarbon materials that contain a substantial quantity of high boiling hydrocarbon fractions. One particular example of a high molecular weight hydrocarbon is a waxy hydrocarbon formed through a Fischer-Tropsch synthesis process. The Fischer-Tropsch waxy hydrocarbon typically includes a distribution of straight chain aliphatic hydrocarbons having 20 carbons or above (i.e., soft wax) and 60 carbons and above (i.e., hard wax).

Exemplary Fischer-Tropsch wax materials include 230T-02-O3 680° F.+, 230T-02-O3 900-950° F. cut, and 230T-02 EOR 950° F.+.

The term "hydrocracking reactor" shall refer to any vessel in which hydrocracking (i.e., reducing the boiling range) of a hydrocarbon in the presence of hydrogen and a hydrocracking catalyst is the primary purpose. Hydrocracking reactors are characterized as having an input port into which a high molecular weight hydrocarbon and hydrogen can be introduced, an output port from which an upgraded material can be withdrawn, and sufficient thermal energy so as to form hydrocarbon free radicals in order to cause fragmentation of larger hydrocarbon molecules into smaller molecules. The hydrocracking reactors included or used in systems and methods of the present invention comprise expanded bed reactors (i.e., a three phase, gas-liquid-solid system).

The terms "upgrade", "upgrading" and "upgraded", when used to describe a hydrocarbon that is being or has been subjected to hydroprocessing, or a resulting material or product, shall refer to one or more of a reduction in the molecular weight of feedstock, a reduction in the boiling range of the feedstock, and/or a reduction in the quantity of impurities, such as sulfur, nitrogen, oxygen, halides, and metals.

The term "expanded bed reactor" refers to a three phase reactor including a solid phase comprised of an expanded bed of a porous catalyst, a gaseous phase comprised of hydrogen gas, and a liquid phase comprised of a feed stream of high molecular weight hydrocarbons contaminated with solid particulates that is introduced into the reactor. The liquid phase feedstream and the gaseous phase hydrogen gas are introduced into the reactor so as to expand the bed of solid catalyst. In other words, the liquid and gaseous phases flow upward against and through the bed of solid catalyst so as to maintain the catalyst bed in a fluidized or expanded configuration.

The present invention relates to a method and related system for hydroprocessing a high molecular weight hydrocarbon material (e.g., a waxy product generated by a Fischer-Tropsch synthesis process) that is contaminated with solid particulates (e.g., catalyst fines from a Fischer-Tropsch reaction). Whereas Fischer-Tropsch catalysts often begin as a ground state metal such as iron and/or cobalt, they typically react with carbon monoxide to form what are believed to be carbides. Such a method and system employs one or more expanded bed reactors, each reactor including a fluidized bed of porous catalyst to catalyze hydrocracking or other hydroprocessing reactions involving hydrogen and the high molecular weight hydrocarbon that is contaminated with catalyst fines. Hydroprocessing the high molecular weight hydrocarbon in an expanded bed reactor results in formation of a hydroprocessed, upgraded material, while advantageously eliminating plugging of the catalyst bed by the catalyst fines. Advantageously, pre-filtering the feedstream to remove substantially all of the solid particulates is not required.

II. Exemplary Systems and Expanded Bed Reactors

FIG. 1 schematically depicts a system 10 for forming Fischer-Tropsch hydrocarbons and subsequently hydroprocessing the waxy, high molecular weight, high boiling range portion of the Fischer-Tropsch hydrocarbons in an expanded bed reactor 32. A raw carbonaceous feedstock material (e.g., coal, natural gas, biomass or other hydrocarbon material) 12 is introduced into a gasifier 16 with oxygen and/or steam 14 to form synthesis gas (i.e., CO and $H_2$) 18, which may be passed through a gas cleaner 20 to remove undesirable impurities (e.g., sulfur, nitrogen, carbon dioxide, and/or metals). The relative amounts of oxygen and/or steam added to the gasifier depends on the carbonaceous feedstock (e.g., natural gas typically requires more steam and coal typically requires more oxygen).

The clean synthesis gas 18' may then be introduced into a reactor 22 that operates on the principle of Fischer-Tropsch synthesis to form mainly straight chain hydrocarbons. Such reactors may typically comprise one or more slurry reactors and/or one or more expanded bed reactors including iron and/or cobalt catalysts for catalyzing the synthesis reaction of CO and $H_2$ to form straight chain hydrocarbons. Through attrition and/or chemical reactions, particles of the active metal catalyst (e.g., iron and/or cobalt) and its supporting structure are worn away and broken off, becoming dispersed throughout the Fisher-Tropsch generated products, particularly the higher molecular weight, high boiling range waxy product fraction. The lower molecular weight, lower boiling range materials are withdrawn from reactor 22 (e.g., in vapor or gaseous form), after which they may be cooled and separated within a vapor/liquid separation drum 24 into a low boiling fraction (e.g., a vapor stream of unreacted synthesis gas and low molecular weight olefins, for example $C_1$-$C_4$) and a higher boiling fraction (e.g., a condensed liquid stream comprising naphtha, diesel, $H_2O$) containing the most valuable products. As will be apparent to one skilled in the art, further separation and/or processing of these various products may be performed as needed.

The relatively high molecular weight waxy product 26 generated in synthesis reactor 22 is withdrawn from reactor 22 for further processing. In order to form more valuable, lower boiling range fractions from the waxy product fraction 26, the waxy fraction may be hydrocracked. Other hydroprocessing reactions may also be performed. Waxy product fraction 26 withdrawn from reactor 22 is typically contaminated with a significant quantity of catalyst particulates derived from the active catalyst operating within reactor 22. Existing systems and methods for upgrading waxy product fraction 26 have required filtration of substantially all of the solid particulates in order to prevent plugging of the catalyst within downstream fixed bed hydrocracking reactors. This filtering has been relatively difficult, expensive, and represents an additional processing step.

Advantageously, the present invention proposes hydrocracking waxy product fraction 26 within an expanded bed type reactor 32 that includes a solid catalyst for catalyzing hydrocracking and/or other hydro-processing reactions. It has been found that use of an expanded bed reactor eliminates plugging of the solid catalyst by the solid particulates present within feedstream 26. This represents a distinct advantage over existing methods and systems where a pre-filtered waxy product fraction is hydrocracked within a fixed bed reactor, as no prefiltering of the feedstream is required with the present inventive method and system. In an expanded bed operation, contaminated solid catalyst can be replaced by withdrawal and addition through a lock-hopper technique under operating conditions (i.e., it is not necessary to shut down the process).

Although not necessary, the waxy product fraction may be passed through an initial separator 28 (e.g., a gravity sediment separator) to recover a majority of the catalyst 30 (e.g., the larger diameter portion having effective diameters greater than about 25 microns) within the Fischer-Tropsch generated wax 26 to yield a partially cleaned wax stream 26'. Volatiles within wax stream 26 may be withdrawn and combined with the stream removed from the top of reactor 22 and sent to vapor/liquid separator 24. Separator 28 may be desirable as it allows recovery and reuse of a portion of catalyst 30, particularly the larger diameter portion, to improve the economics of the overall process. Recovered catalyst 30 may typically include a range of effective diameters greater than about 20 microns, and more typically between about 50 and about 250 microns.

Recovery and reuse of catalyst 30 may be advantageous as it reduces the amount of make up catalyst that must be added to reactor 22. Recovery of the large diameter portion of catalyst 30 is relatively inexpensive and simple, in contrast to expensive and complex filtering methods and systems that must be used to remove the very small catalyst particulates (e.g., those less than about 10 microns, particularly those less than about 5 microns, and more particularly those between about 1 and about 3 microns and smaller). In addition, the relatively low cost of recoving the larger catalyst particles may be completely offset by the savings realized through the reduced need for adding make-up catalyst that must otherwise be added to synthesis reactor 22. This is in contrast to very expensive filtration for removing the very fine catalyst particles, which is performed only as a necessity to meet product specifications and/or prevent plugging of the downstream hydrocracking reactor. In general, the smaller the particle size, the more difficult removal becomes. As such, a waxy material which includes a substantial portion of very small particles can be very expensive to prefilter before the fixed bed reactor. There is little or no offset of the expensive filtration costs realized through any value of the removed very fine catalyst particles, because it would generally be inadvisable to reintroduce such small particles into synthesis reactor 22, and because the catalyst metal itself, at least in the case of iron, has relatively little economic value.

After passing through initial separator 28, the partially cleaned Fischer-Tropsch wax stream 26' may still contain a substantial portion of solid particulates (e.g., 500 to 1500 ppm), with a substantial portion of these solid particulates having an effective diameter of less than about 25 microns. The solid particulates may be present within the feedstream at a concentration between about 5 ppm and about 200,000 ppm, more typically between about 50 ppm and about 10,000 ppm, and most typically between about 200 ppm and about 2,000 ppm. Introducing such a feedstream 26' into a conventional fixed bed hydrocracking or other hydroprocessing reactor would quickly result in plugging of the reactor and/or deactivation of the catalyst bed.

The solid particulates may include a distribution of various sizes. If the feedstream 26' is not passed through an initial separator, it may include a substantial fraction of larger effective diameters, for example effective diameters greater than about 30 microns (e.g., between about 50 and 150 microns, or even larger). In any case, partially cleaned feedstream 26' may include solid particulates having an effective diameter of about 100 microns and less, of about 10 microns and less, of about 5 microns and less, and of about 3 microns and less. The feedstream 26' may include a substantial portion of solid particulates having an effective diameter between about 1 and about 3 microns, and/or a substantial portion of solid particulates having an effective diameter of less than 1 micron.

Rather than hydrocracking or otherwise hydroprocessing feedstream 26' within a fixed bed reactor, the Fischer-Tropsch generated wax 26' contaminated with solid particulates is advantageously introduced into an expanded bed reactor 32 along with hydrogen rich gas 34 in order to hydroprocess the waxy Fischer-Tropsch generated product 26' into lower molecular weight and/or lower boiling range products having greater value (e.g., naphtha, diesel). Effluent 36 withdrawn from the expanded bed reactor 32 may be fed to a distillation separator 38 for separating the lower boiling range products 40, such as naphtha and diesel, from the unconverted wax 42 containing catalyst particles.

The un-reacted wax recovered within stream 42 typically has a much higher concentration of catalyst particles as a result of hydrocracking the majority of wax (e.g., up to 90% or more) into lower boiling range products 40. As a result, the remaining wax product 42 can be more economically separated from the fines since there is much less wax and a much higher concentration of fines. Separation can be performed by, e.g., gravitational settling, centrifuging, and/or filtration. To assist filtration at lower temperatures, the wax can be dissolved in a solvent. The filtered wax product can then be used according to product specifications. In one embodiment, a partially filtered wax product can be recycled into reactor 32 with feed 26'.

Use of an expanded bed hydrocracking reactor 32 in such a system eliminates the need for expensive filtration to remove substantially all of the solid particulates from the waxy Fischer-Tropsch generated product (e.g., below 5 ppm). Such filtration has been necessary in existing methods and systems as the waxy product fraction has been hydroprocessed within a fixed bed type reactor where the presence of any substantial solid particulate component results in plugging and deactivation of the fixed bed catalyst. Use of the expanded bed reactor has been found to be advantageous as it allow s the Fischer-Tropsch waxy material to be hydroprocessed without the need for an expensive and/or time consuming filtration step.

Depending upon the operating temperatures in reactor 22 and expanded bed reactor 32, it may be advantageous to either heat or cool feedstream 26 before it enters the expanded bed reactor 32. Heating or cooling of the feedstream may be helpful in keeping the expanded bed reactor operating at a constant temperature as a result of heat released by the hydrogen consumed in the expanded bed reactor.

Figure 2:
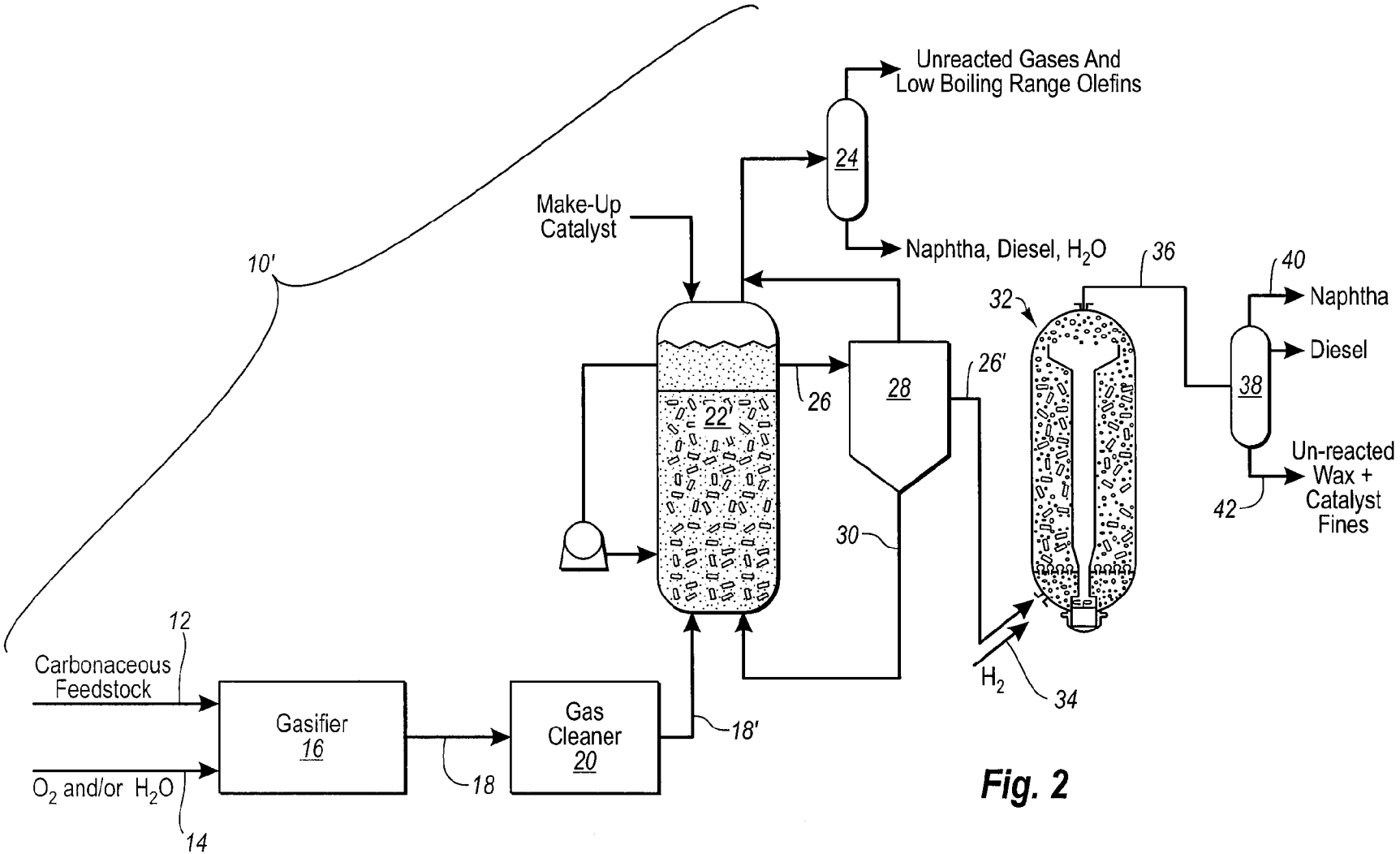
FIG. 2 is a schematic diagram illustrating an exemplary ebullated bed system for forming a Fischer-Tropsch high molecular weight hydrocarbon wax followed by hydrocracking the wax in an expanded bed reactor.

FIG. 2 schematically depicts an alternative system 10' for forming Fischer-Tropsch hydrocarbons and subsequently hydroprocessing the waxy, high molecular weight, high boiling range portion of the Fischer-Tropsch hydrocarbons in an expanded bed reactor 32. The main difference between the systems depicted in FIGS. 1 and 2 is the use of an expanded bed reactor 22' in FIG. 2 rather than the slurry bed reactor 22 shown in FIG. 1. Otherwise, the systems are essentially the same. The expanded bed reactor 22' shown in FIG. 2 differs from the slurry bed reactor 22 of FIG. 1 in that it includes a recirculation pump to maintain the solid catalyst in an expanded (or ebullated) condition, which is necessary due to the generally larger catalyst particles utilized in the ebullated bed reactor 22'.

Figure 3:
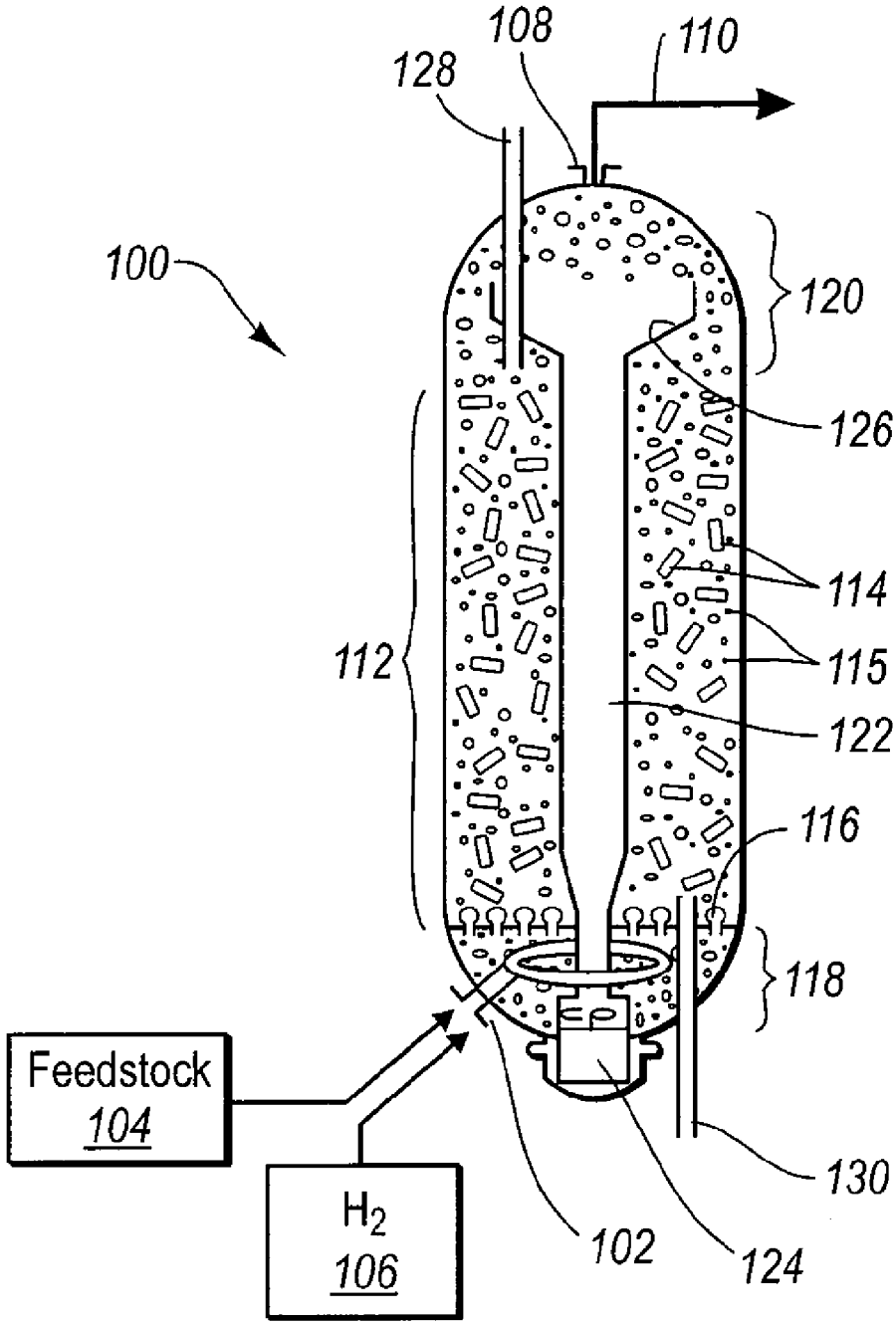
FIG. 3 is a schematic diagram illustrating an exemplary expanded bed reactor that can be used according to the inventive method to hydrocrack a high molecular weight hydrocarbon contaminated with solid particulates.

FIG. 3 schematically depicts a more detailed view of an exemplary expanded bed reactor 100 that can be used to process a hydrocarbon material contaminated with solid particulates. Expanded bed reactor 32 of FIG. 1 may be identical to reactor 100 of FIG. 2A. Expanded bed reactor 100 includes an input port 102 (e.g., a ring with multiple holes) near the bottom through which a feedstock 104 of high molecular weight hydrocarbons (e.g., the waxy product fraction from a Fischer-Tropsch synthesis reaction) contaminated with fine particulates and pressurized hydrogen gas 106 are introduced. Reactor 100 also includes an output port 108 at the top through which an upgraded feedstock 110 is withdrawn.

Expanded bed reactor 100 further includes an expanded catalyst zone 112 comprising a solid catalyst 114 that is maintained in an expanded or fluidized state against the force of gravity by upward movement of feedstock and gas (schematically depicted as bubbles 115) through the expanded bed reactor 100. The amount of expansion of the solid catalyst can be as high as 40%, but will typically be in a range of about 10% to about 20% in order for the catalyst to be more concentrated within the feedstock to provide greater catalytic activity. The lower end of the expanded catalyst zone 112 is defined by a distributor grid plate 116, which separates the expanded catalyst zone 112 from a plenum 118 located between the bottom of the expanded bed reactor 100 and the distributor grid plate 116. The distributor grid plate 116 distributes the hydrogen gas and feedstock evenly across the reactor and prevents the solid catalyst particles or structures 114 from falling by the force of gravity into the lower catalyst free zone 118. Above the expanded catalyst zone 112 is an upper catalyst free zone 120.

Reaction liquid within the expanded bed reactor 100 is continuously recirculated from the upper catalyst free zone 120 to the lower catalyst free zone 118 of the expanded bed reactor 100 by means of a recycling channel 122 disposed in the center of the expanded bed reactor 100 in communication with a recirculation pump 124 disposed at the bottom of the expanded bed reactor 100. At the top of the recycling channel 122 is a funnel-shaped recycle cup 126 through which reaction liquid is drawn from the upper catalyst free zone 120. The reaction liquid drawn downward through the recycling channel 122 enters the lower catalyst free zone 118 and then passes up through the distributor grid plate 116 and into the expanded catalyst zone 112, where it is blended with the feedstock 104 and hydrogen gas 106 entering the expanded bed reactor 100 through the input ring 102. Continuously circulating reaction liquid upward through the expanded bed reactor 100 advantageously maintains the catalyst 114 in an expanded or fluidized state within the expanded catalyst zone 112, minimizes channeling, controls reaction rates, and keeps heat released by the exothermic hydrogenation reactions to a safe level.

Fresh catalyst 114 is introduced into the expanded bed reactor 100, more specifically the expanded catalyst zone 112, through a catalyst input tube 128 that passes through the top of the expanded bed reactor 100 and directly into the expanded catalyst zone 112. Spent catalyst 114 is withdrawn from the expanded catalyst zone 112 through a catalyst withdrawal tube 130 that passes from a lower end of the expanded catalyst zone 112 through both the distributor grid plate 116 and the bottom of the expanded bed reactor 100. It will be appreciated that the catalyst withdrawal tube 130 operates such that a random distribution of catalyst 114 is withdrawn from the expanded bed reactor 100. Periodic withdrawal of catalyst 114 allows the removed and spent catalyst to either be disposed of or to be regenerated.

Advantageously, periodic withdrawal of the catalyst 114 allows catalyst that may become somewhat plugged or otherwise deactivated (e.g., by the solid particulates) to be removed from the reactor without requiring reactor shut down. Spent, removed catalyst 114 may be regenerated so that it can be used again. Advantageously, as expanded bed reactor 100 is able to hydrocrack the high molecular weight hydrocarbon material contaminated with solid particulate without requiring pre-filtration and by separation of the particulates from the reaction liquid. The particulates may be the particulates will clog the spaces between catalyst 114, requiring reactor shut down and cleaning, as might otherwise be expected in the case of a fixed bed reactor.

It is believed that because the solid catalyst 114 within expanded catalyst zone 112 is not stationary, but rather is in constant movement, plugging and deactivation by the solid particulates within the feed stream 104 is less likely to occur. In addition, catalyst 114 can be removed periodically through withdrawal tube 130 while new catalyst can be added through input tube 128. In this way, even if some plugging and/or deactivation of the catalyst 114 does occur, the reactor 100 can continue to operate as spent catalyst can be removed and fresh catalyst added, which is a distinct advantage over a fixed catalyst bed type reactor where no such simultaneous catalyst removal and reactor operation is possible.

Figure 4:
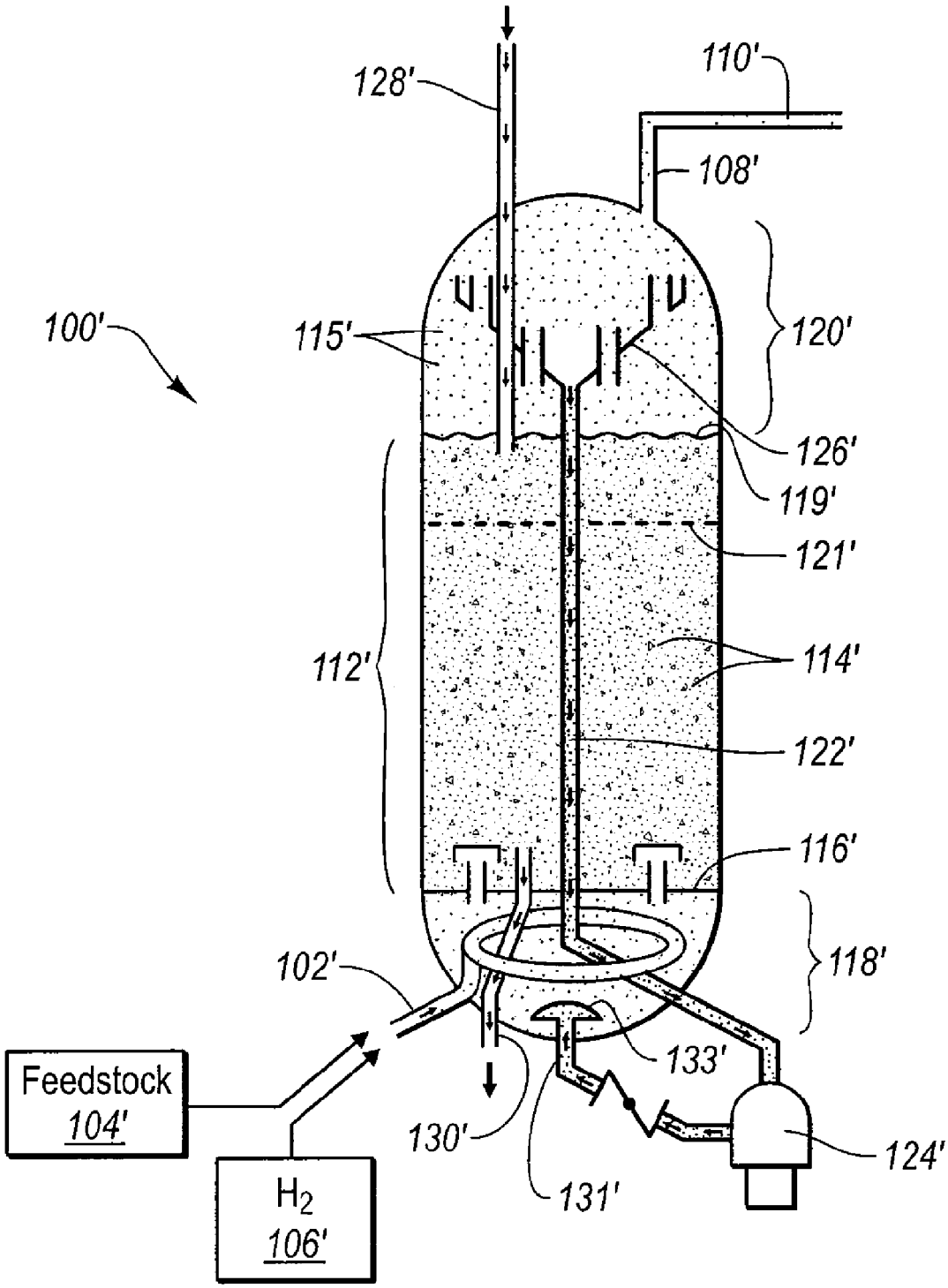
FIG. 4 is a schematic diagram illustrating an exemplary expanded bed reactor that can be used according to the inventive method to hydrocrack a high molecular weight hydrocarbon contaminated with solid particulates.

FIG. 4 schematically depicts another expanded bed reactor 100'. Expanded bed reactor 100' includes an input port 102' through which a feedstock 104' of high molecular weight hydrocarbons (e.g., the waxy product fraction from a Fischer-Tropsch synthesis process) contaminated with solid particulates and pressurized hydrogen gas 106' are introduced and an output port 108' through which upgraded feedstock 110' is withdrawn. An expanded catalyst zone 112' comprising a solid catalyst 114' is bounded by a distributor grid plate 116', which separates the expanded catalyst zone 112' from a plenum 118' between the bottom of the reactor 100' and the distributor grid plate 116', and an upper end 119', which defines an approximate boundary between the expanded catalyst zone 112' and an upper catalyst free zone 120'. A boundary 121' shows the approximate level of catalyst 114' when not in an expanded or fluidized state.

The feedstock is continuously recirculated within the reactor 100' by means of a recycling channel 122' in communication with a recirculation pump 124' disposed outside of the reactor 100'. Feedstock is drawn through a funnel-shaped recycle cup 126' from the upper catalyst free zone 120'. The recycle cup 126' is equipped with riser tubes, which helps separate hydrogen bubbles 115' from the feedstock 104' so as to prevent cavitation of recirculation pump 124'. Recycled reactor liquid enters the lower catalyst free zone 118', where it is blended with the feedstock 104' and hydrogen gas 106', and the mixture passes up through the distributor grid plate 116' and into the expanded catalyst zone 112'. Fresh catalyst 114' may be introduced into the expanded catalyst zone 112' through a catalyst input tube 128', and spent catalyst is withdrawn from the expanded catalyst zone 112' through a catalyst discharge tube 130'.

Periodic withdrawal of catalyst 114' allows the removed and spent catalyst to either be disposed of or to be regenerated. In the case when expensive active metals are employed within the catalyst, it is preferable to regenerate the catalyst for reuse or recovery of the precious active metals. Advantageously, periodic withdrawal of the catalyst 114' allows catalyst that may become somewhat plugged or otherwise deactivated (e.g., by the solid particulates) to be removed from the reactor without requiring reactor shut down. Spent, removed catalyst 114' may be regenerated so that it can be used again.

The main difference between the expanded bed reactor 100' and the expanded bed reactor 100 is the location of the recirculation pump. The recirculation pump 124' in the reactor 100' is located external to the reaction chamber. The recirculating reactor liquid is introduced through a recirculation port 131' at the bottom of the reactor 100'. The recirculation port 131' includes a bubble cap 133', which aids in evenly distributing the recycled reactor liquid through the plenum 118'. The upgraded liquid 110' may subsequently be separated into light and heavy fractions.

Advantageously, expanded bed reactor 100' is able to hydrocrack or otherwise hydroprocess the high molecular weight hydrocarbon feedstock contaminated with solid particulates without requiring pre-filtration and separation of the solid particulates from the feedstock. The solid particulates may be introduced into reactor 100' as part of feedstock 104' without significant risk that the solid particulates will plug and deactivate catalyst 114', requiring reactor shut down and cleaning, as might otherwise be expected.

It is believed that because the solid catalyst 114' within expanded catalyst zone 112' is not stationary, but rather is in constant movement, plugging and deactivation by the solid particulates within the feed stream 104' is less likely to occur. In addition, catalyst 114' can be removed periodically through withdrawal tube 130' while new catalyst can be added through input tube 128'. In this way, even if some plugging and/or deactivation of the catalyst 114' does occur, the reactor 100' can continue to operate as spent catalyst can be removed and fresh catalyst added, which is a distinct advantage over a fixed catalyst bed type reactor where no such simultaneous catalyst removal and reactor operation is possible.

III. EXAMPLES

Example 1

A Fischer-Tropsch wax product having a boiling range of 950° F.+ was introduced into a bench scale hydrocracking reactor having 25 cc batch reactors. The catalyst was prepared from a solution of $H_2PtCl_6$ or $Pt(NH_3)_4Cl_2$ impregnated onto a porous super acid catalyst support comprising tungstated zirconia ($ZrO_2/WO_3$) via an incipient wetness method, followed by calcining at 500° C. for 3 hours. The catalyst comprised 500 ppm platinum promoted $ZrO_2/WO_3$ hybrid catalyst with a 1:1 weight ratio of CBV-21A zeolite.

The hydrocracking temperature within the hydrocracking reactor was about 450-700° F. (ideally 680° F.), the initial hydrogen pressure was about 500-800 psig (ideally 500 psig), and the reaction time was about 20-30 minutes. All samples were diluted with carbon disulfide ($CS_2$) at 20 times volume. Since the simulated distillation has a boiling point limit of 1300° F., reasonable simulation was applied to collect all signals cover a boiling point to 1800° F. The results of the test showed that 50 weight % of the original 950° F.+ wax was hydrocracked into 30 weight % naphtha (gasoline) and 20% weight % diesel.

Example 2

A feedstream of Fischer-Tropsch generated wax material that is contaminated with solid particulates is introduced into an expanded bed hydrocracking reactor (e.g., reactor 100 of FIG. 2A). The solid particulates are present in the feedstream at a concentration of about 250 ppm. The solid particulates include particles between about 5 and about 10 microns, between about 3 and about 5 microns, and between about 1 and about 3 microns effective diameter. The expanded bed hydrocracking reactor is able to upgrade the wax material by hydrocracking the relatively long straight chain hydrocarbons initially having between about 22 and about 100 carbons so as to produce relatively shorter straight chain hydrocarbons (e.g., naphtha and diesel) of greater value. The expanded hydrocracking catalyst is able to effectively catalyze the hydrocracking reactions without becoming plugged or deactivated in spite of the presence of solid particulates within the feedstream as a result of being in an expanded and continuously moving condition.

Example 3

A feedstream of Fischer-Tropsch generated wax material that is contaminated with solid particulates is introduced into an expanded bed hydrocracking reactor (e.g., reactor 100 of FIG. 2A). The solid particulates are present in the feedstream at a concentration of about 2000 ppm. The solid particulates include particles between about 50 and about 200 microns, between about 5 and about 10 microns, between about 3 and about 5 microns, and between about 1 and about 3 microns effective diameter. The expanded bed hydrocracking reactor is able to upgrade the wax material by hydrocracking the relatively long straight chain hydrocarbons initially having between about 22 and about 100 carbons so as to produce relatively shorter straight chain hydrocarbons (e.g., naphtha and diesel) of greater value. The expanded hydrocracking catalyst is able to effectively catalyze the hydrocracking reactions without becoming plugged or deactivated in spite of the presence of solid particulates within the feedstream as a result of being in an expanded and continuously moving condition.

Comparative Example 4

A feedstream of Fischer-Tropsch generated wax material that is contaminated with solid particulates is introduced into a fixed bed hydrocracking reactor. The solid particulates are present in the feedstream at a concentration of about 250 ppm. The solid particulates include particles between about 5 and about 10 microns, between about 3 and about 5 microns, and between about 1 and about 3 microns effective diameter. The fixed bed hydrocracking reactor is not able to upgrade the wax material by hydrocracking the relatively long straight chain hydrocarbons initially having between about 22 and about 100 carbons because the fixed bed of catalyst quickly becomes plugged by the solid particulates within the feedstream, causing a drop in pressure. The reactor must be shut down so as to allow the supported catalyst to be replaced.

Comparative Example 5

A feedstream of Fischer-Tropsch generated wax material that is contaminated with solid particulates is introduced into a fixed bed hydrocracking reactor. The solid particulates are present in the feedstream at a concentration of about 10 ppm. The solid particulates include particles between about 5 and about 10 microns, between about 3 and about 5 microns, and between about 1 and about 3 microns effective diameter. The fixed bed hydrocracking reactor is able to upgrade the wax material by hydrocracking the relatively long straight chain hydrocarbons for a short time, but then the fixed bed of porous supported catalyst becomes plugged by the solid particulates within the feedstream. The reactor must be shut down so as to allow the supported catalyst to be replaced.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope. the claims are to be embraced within their scope.

What is claimed is:

1. A method for hydrocracking a high molecular weight hydrocarbon contaminated with solid particulates, comprising:

providing a feedstream of high molecular weight hydrocarbons that consists essentially of a mixture of aliphatic hydrocarbons contaminated with solid particulates;

introducing the feedstream of high molecular weight hydrocarbons contaminated with solid particulates into at least one expanded bed hydrocracking reactor comprising a solid phase comprised of an expanded bed of a solid catalyst, a liquid phase, and a gaseous phase comprised of hydrogen gas, the expanded bed hydrocracking reactor further comprising:

an input port at a bottom of the reactor through which the feedstream of high molecular weight hydrocarbons is introduced;

an output port at a top of the reactor an expanded catalyst zone comprised of the solid catalyst maintained in an expanded or fluidized state by upward movement of liquid and gas through the reactor;

a recycling channel extending from the bottom of the reactor and passing through the expanded catalyst zone and terminating with a recycle cup disposed above the expanded catalyst zone; and a recirculation pump that circulates liquid entering the recycle cup down through the recycling channel and into the expanded bed reactor at a location below the expanded catalyst zone; and operating the at least one expanded bed reactor to form a hydrocracked material from the high molecular weight hydrocarbons having a lower molecular weight and lower boiling range than the feedstream of high molecular weight hydrocarbons, wherein the hydrocracked material consists essentially of aliphatic hydrocarbons.

2. A method as recited in claim 1, wherein the high molecular weight hydrocarbons comprise substantially straight chain aliphatic hydrocarbons.

3. A method as recited in claim 2, wherein the substantially straight chain aliphatic hydrocarbons comprise waxes derived from a Fischer-Tropsch process.

4. A method as recited in claim 3, wherein the substantially straight chain aliphatic hydrocarbons comprise hydrocarbons having at least 20 carbon atoms each.

5. A method as recited in claim 3, wherein the substantially straight chain aliphatic hydrocarbons comprise hydrocarbons having at least 60 carbon atoms each.

6. A method as recited in claim 1, wherein the solid particulates comprise at least one of iron or cobalt.

7. A method as recited in claim 1, wherein the solid particulates comprise particles having an effective diameter of less than about 250 microns.

8. A method as recited in claim 1, wherein the solid particulates comprise particles having an effective diameter of less than about 20 microns.

9. A method as recited in claim 1, wherein the solid particulates comprise particles having an effective diameter between about 1 and about 3 microns.

10. A method as recited in claim 1, wherein the solid particulates are present in the feedstream of high molecular weight hydrocarbons at a concentration between about 5 ppm and about 50,000 ppm.

11. A method as recited in claim 1, wherein the solid particulates are present in the feedstream of high molecular weight hydrocarbons at a concentration between about 10 ppm and about 5000 ppm.

12. A method as recited in claim 1, wherein the solid particulates are present in the feedstream of high molecular weight hydrocarbons at a concentration between about 20 ppm and about 2000 ppm.

13. A method as recited in claim 1, wherein the high molecular weight hydrocarbons have a first average molecular weight, and wherein operating the at least one expanded bed reactor comprises hydrocracking the high molecular weight hydrocarbons having the first average molecular weight so as to produce hydrocarbons having a second average molecular weight, the second average molecular weight being lower than the first average molecular weight.

14. A method as recited in claim 1, wherein the solid catalyst comprises an acidic metal oxide catalyst.

15. A method as recited in claim 14, wherein the acidic metal oxide catalyst comprises at least one of alumina, silica or zirconia.

16. A method as recited in claim 1, wherein the feedstream contaminated with solid particulates is either cooled or heated before being introduced into the at least one expanded bed reactor.

17. A method for hydroprocessing an aliphatic wax derived from a Fischer-Tropsch process that is contaminated with catalyst particulates, comprising:

providing a feedstream of aliphatic wax derived from a Fischer-Tropsch process that is contaminated with fragmented Fischer-Tropsch catalyst particulates;

introducing the feedstream wax derived from a Fischer-Tropsch process that is contaminated with fragmented Fischer-Tropsch catalyst particulates into an ebullated bed reactor having a recycling cup disposed above an expanded catalyst zone and a recycle channel extending through and below the expanded catalyst zone; and operating the ebullated bed reactor so as to form a hydrocracked hydroprocessed material from the wax having a lower boiling point than the wax, the hydrocracked material consisting essentially of aliphatic hydrocarbons.

18. A method as recited in claim 17, wherein the fragmented Fischer-Tropsch catalyst particulates comprise at least one of iron or cobalt.

19. A method as recited in claim 18, wherein the fragmented Fischer-Tropsch catalyst particulates comprise particles having an effective diameter of less than about 20 microns.

20. A method as recited in claim 17, wherein the fragmented Fischer-Tropsch catalyst particulates are present in the feedstream at a concentration of at least about 20 ppm.

* * * * *

UNITED STATES PATENT AND TRADEMARK OFFICE

CERTIFICATE OF CORRECTION

PATENT NO. : 7,615,142 B2
APPLICATION NO. : 11/469237
DATED : November 10, 2009
INVENTOR(S) : Lee et al.

It is certified that error appears in the above-identified patent and that said Letters Patent is hereby corrected as shown below:

Column 1
Line 24, change "open-up" to --open up--
Line 57, change "a" to --an--

Column 2
Line 6, change "reactors" to --reactor--
Line 13, change "suffiently" to --sufficiently--

Column 7
Line 30, change "recoving" to --recovering--

Column 8
Line 40, change "allow s" to --allows--
Line 45, change "26" to --26'--

Column 9
Line 1, change "2A" to --3--

Column 10
Line 5, after "The particulates may be", insert --introduced into reactor 100 with the feedstock 104 without significant risk that--

Column 11
Line 18, change "feed stream 104'" to --feedstream--
Line 48, change "cover" to --over--
Line 58, change "2A" to --3--

Column 12
Line 12, change "2A" to --3--

Signed and Sealed this

First Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,615,142 B2
APPLICATION NO. : 11/469237
DATED : November 10, 2009
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 268 days.

Signed and Sealed this

Nineteenth Day of October, 2010

David J. Kappos

David J. Kappos
*Director of the United States Patent and Trademark Office*